US005195405A

United States Patent [19]

Folkrod

[11] Patent Number: 5,195,405

[45] Date of Patent: Mar. 23, 1993

[54] ANTI-CRUSH TOOL

[76] Inventor: Michael J. Folkrod, 575 Stagecoach Rd., Arroyo Grande, Calif. 93420

[21] Appl. No.: 838,906

[22] Filed: Feb. 21, 1992

[51] Int. Cl.[5] ..... B25B 23/00

[52] U.S. Cl. ..... 81/180.1; 8/488; 8/DIG. 1; 29/240; 29/426.5

[58] Field of Search ..... 81/DIG. 1, 180.1, 488; 269/47; 138/89, 96 R; 29/255, 280, 282, 240, 426.5

[56] References Cited

U.S. PATENT DOCUMENTS

| | | | |
|---|---|---|---|
| 1,487,592 | 3/1924 | Novotny | 29/255 |
| 1,715,792 | 6/1929 | Shrum | 138/96 R |
| 2,860,535 | 11/1958 | Fowler | 29/280 |
| 2,909,210 | 10/1959 | Bennett | 29/255 |
| 3,370,615 | 2/1968 | Tamaki et al. | 138/96 |
| 3,947,945 | 4/1976 | Gulistan | 29/282 |
| 3,991,458 | 11/1976 | Donoff | 29/282 |
| 4,899,409 | 2/1990 | Cox, Jr. | 7/167 |
| 5,035,265 | 7/1991 | Chen | 138/96 R |
| 5,095,607 | 3/1992 | Simon et al. | 29/255 |

*Primary Examiner*—Roscoe V. Parker
*Attorney, Agent, or Firm*—Daniel C. McKown

[57] ABSTRACT

A tool useful to plumbers and other persons who work with pipe and tubing, to facilitate gripping and applying torque to a free end of a piece of pipe or tubing includes a plug portion of cylindrical shape that is driven into the free end of the pipe for the purpose of reinforcing the wall of the pipe so that it can withstand the radial forces exerted by a wrench or over-center pliers during the application of torque to the pipe. A shoulder portion limits the depth to which the plug portion can be inserted into the pipe, and a handle portion is connected to the shoulder portion for convenience in handling the tool.

1 Claim, 1 Drawing Sheet

FIG. 2
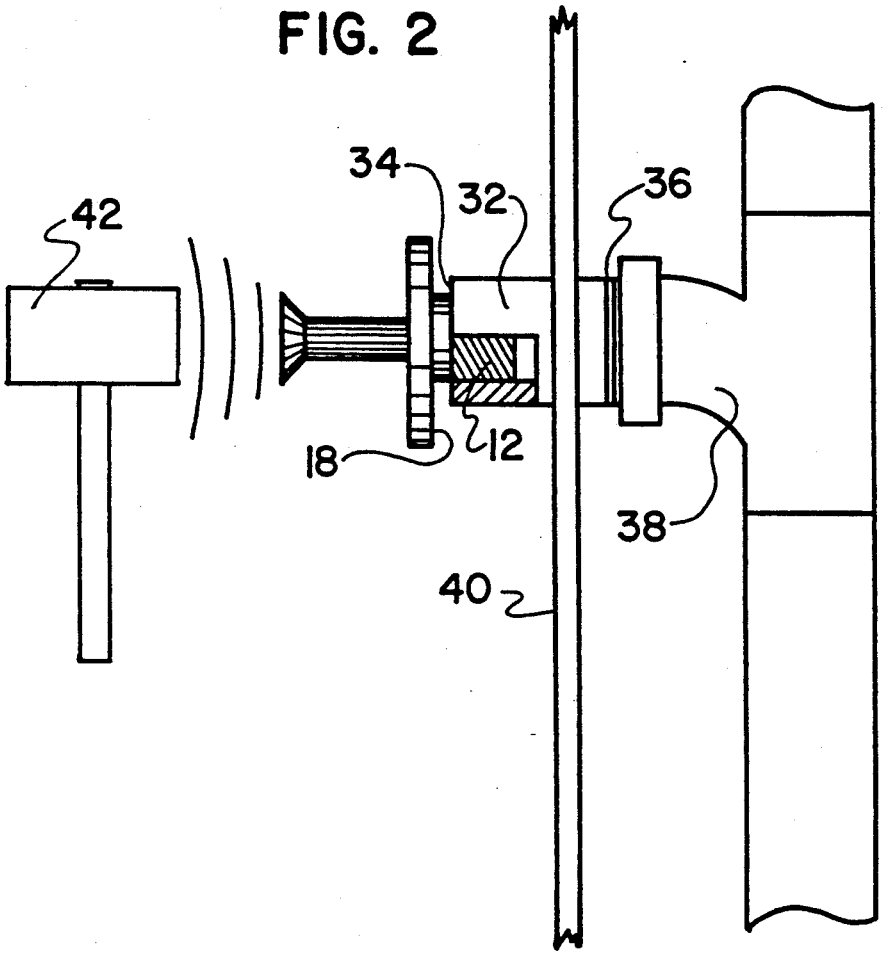
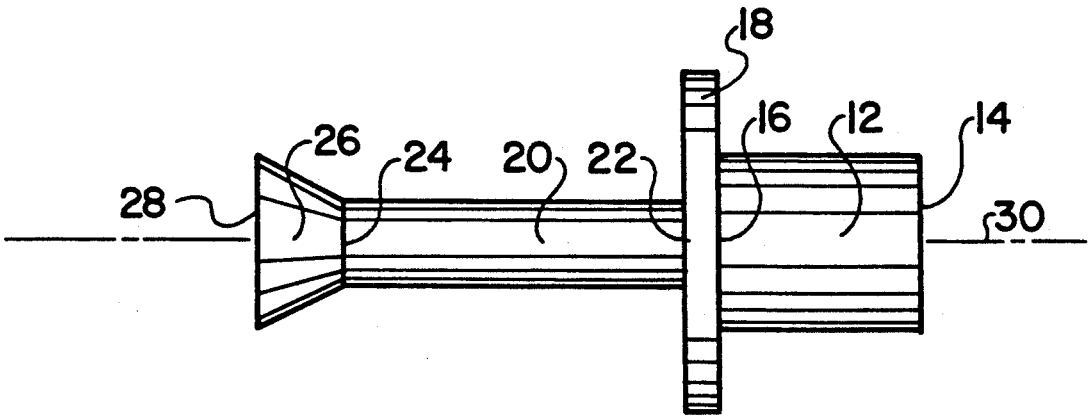
FIG. 1

ANTI-CRUSH TOOL

BACKGROUND OF THE INVENTION

The present invention is in the field of plumbing, and more specifically relates to a tool to facilitate gripping and applying torque to a free end of a piece of pipe or tubing.

Although the present invention is relatively simple, a search of the prior art failed to discover a device having its essential features.

In U.S. Pat. No. 3,448,772, Delamater shows a waste pipe plug of a plastic material that includes a plug portion and a stop collar, but does not include a handle or anvil.

In U.S. Pat. No. 2,321,667, Foster shows a stopper for use with gas mains. Although a portion of the stopper fits into a pipe, the patented device bears little resemblance to the present invention.

In U.S. Pat. No. 2,279,118 issued to Fortune, et al., there is shown a plug that can be screwed into the end of a pipe for the purpose of lifting the pipe. This pipe is used in the oil industry.

In U.S. Pat. No. 3,200,984, Fueslein, et al., show a pressure seal plug that is made of a resilient deformable material such as nature and synthetic rubber, as well as certain plastics.

In U.S. Pat. No. 4,899,409, Cox, Jr., shows a manual tool that is useful in preparing the end of a tube for joining it to another tube.

The tool of the present invention finds its greatest use in the field of plumbing and pipe fitting, where it is some times necessary to unscrew a length of pipe from some type of fitting to which it has been screwed. Typically, the piece of pipe has corroded sc that the threaded end is difficult to move with respect to the fixture. Opposite the threaded end is a free end, to which a wrench or pliers are to be applied for the purpose of applying torque to the length of pipe.

The specific problem is that if one grips the free end tightly enough to permit the necessary torque to be applied, there is a strong likelihood that the pliers or wrench will damage the free end of the pipe, particularly if the free end is also corroded. The problem also arises when the wall of the pipe is relatively thin as in the case of tubing. As will be seen below, the tool of the present invention permits the pipe or tubing to be gripped very tightly by a wrench or pliers without, at the same time, damaging the free end.

SUMMARY OF THE INVENTION

In accordance with the present invention, there is provided a tool that has a plug portion that fits snugly into the free end of the pipe so that forces applied in a radial direction to the free end by a wrench or pliers are transmitted through the pipe to the inserted plug which thereby supports the wall of the free end of the pipe, preventing it from being deformed by the wrench or pliers.

Further in accordance with the present invention there is provided a shoulder encircling the plug. The shoulder serves to limit how far the plug can be inserted into the pipe and also provides a convent gripping surface for withdrawing the plug from the pipe.

Further in accordance with the present invention, the tool includes a handle portion that is useful for holding and positioning the plug as the plug is being driven into the open free end of the pipe.

The free end of the handle may be enlarged and shaped to receive the blows of a hammer that is used to tap the plug portion into the pipe.

In the preferred embodiment, the plug portion, the shoulder portion, and the handle portion all constitute portions of a unitary article, and in the preferred embodiment, the plug portion, the shoulder portion, and the handle portion all are coaxial and are figures of revolution, i.e., they all have circular cross sections in planes perpendicular to the axis.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a side elevational view showing a preferred embodiment of the tool of the present invention; and, FIG. 2 is a side elevational view showing the tool of FIG. 1 in use.

DETAILED DESCRIPTION OF THE PREFERRED EMBODIMENT

As best seen in FIG. 1, in a preferred embodiment the tool of the present invention includes a cylindrical plug portion 12 having a first end 14 and a second end 16. Attached to the second end 16 is a shoulder portion 18. A handle portion 20 has a first end 22 that is connected to the shoulder portion 18, and the handle portion 20 also has a second end 24 that is connected to a striking portion 26 that has a flat surface 28 for receiving blows of a hammer.

In the preferred embodiment, the plug portion 12, the shoulder portion 18, and the handle portion 20 are each solids of revolution about the axis 30, and this permits the tool to be formed by turning in a lathe.

The striking portion 26 is optional, since a user could strike his hammer against the second end 24 of the handle portion. Nevertheless, the striking portion is desirable because it provides an enlarged striking area and because it is helpful in carrying the tool.

FIG. 2 illustrates the use of the tool of the present invention. In a typical plumbing situation, a length of pipe 32 has a free end 34 and a threaded end 36 which is threaded into a fixture 38. Sometimes the piece of pipe 32 extends through a wall 40. Not infrequently, corrosion has caused the threaded end 36 to become very difficult to remove from the fixture 38. Also, corrosion may have affected the free end 34 of the pipe weakening its walls. Owing to the weakened condition of the walls, if a wrench or over-center pliers were applied to the free end 34 in an attempt to unscrew the pipe from the fixture 38, the pressure of the wrench would damage the free end of the pipe.

When confronted by this situation, a user of the present invention would first insert the plug portion 12 of the tool into the free end 34 of the pipe. Sometimes in order to insert the plug portion it is necessary to drive it into the pipe by means of a hammer 42.

Once normally the plug portion would be driven in until the shoulder portion 18 makes contact with the free end 34 of the pipe. The presence of the plug portion 12 reinforces the wall of the pipe 32 allowing the wall to withstand the severe pressures exerted by a wrench or an overcenter pliers.

With the plug portion still within the pipe 32, the user then grips the pipe with his wrench and applies torque to it in an effort to free the pipe from the fixture 38. Normally, the plug portion 12 will be retained within the pipe until the piece of pipe has been separated from the fixture 38. Thereafter, the plug portion may be withdrawn from the piece of pipe 32.

In order for the plug portion to provide a good reinforcement for the walls of the pipe, it is essential that the outside diameter of the plug portion should be approximately equal to the inside diameter of the piece of pipe 32. Ideally, the plug portion would fit within the pipe in a tight sliding fit.

Thus, there has been described a tool useful to persons working with pipe or tubing for permitting the application of a large torque to a piece of pipe without deforming or damaging the wall of the pipe.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A method for gripping and applying torque to a free end of a pipe, said method noteworthy for minimizing damage to the pipe, said method employing an anti-crush tool that includes a cylindrical shaped plug portion having an outside diameter that is slightly less than the inside diameter of the pipe so as to permit the plug portion to be inserted into the pipe in a tight sliding fit, the plug portion having a first end and a second end, the anti-crush tool further including a shoulder portion connected to the second end of the plug portion for limiting how far the plug portion can be inserted into the pipe, the anti-crush tool further including a handle portion that extends from the shoulder portion in a direction opposite to the direction the plug portion extends and that has a striking surface, said method comprising the steps of:

a) driving the first end of the plug portion into the pipe by gently tapping on the striking surface of the handle portion until the shoulder portion makes contact with the end of the pipe;

b) gripping the free end of the pipe with a gripping tool, the plug portion preventing deformation of the free end of the pipe by the applied gripping force;

c) applying torque to the free end of the pipe by use of the gripping tool;

d) releasing the gripping tool;

e) withdrawing the plug portion of the anti-crush tool from the free end of the pipe by pulling on the handle portion.

* * * * *